US005951347A

United States Patent [19]

Hudson et al.

[11] Patent Number: 5,951,347

[45] Date of Patent: Sep. 14, 1999

[54] WATERSPORT BOARD FIN CONSTRUCTION

[75] Inventors: Paul R. Hudson, Orange, Calif.; David S. Skedeleski, Aiea, Hi.

[73] Assignee: Surfco Hawaii, Pearl City, Hi.

[21] Appl. No.: 09/127,869

[22] Filed: Aug. 3, 1998

[51] Int. Cl.[6] ..... A63C 15/06

[52] U.S. Cl. ..... 441/79; 114/140

[58] Field of Search ..... 441/74, 79, 65; 114/39.25, 140

[56] References Cited

U.S. PATENT DOCUMENTS

| | | | |
|---|---|---|---|
| 5,242,322 | 9/1993 | Chellemi et al. | 441/79 |
| 5,273,472 | 12/1993 | Skedeleski et al. | 441/79 |
| 5,306,188 | 4/1994 | Skedeleski et al. | 441/79 |

*Primary Examiner*—Jesus D. Sotelo

*Attorney, Agent, or Firm*—Nixon & Vanderhye P.C.

[57] ABSTRACT

A watersport board fin has a rigid body element with a leading edge and trailing edge, and a rigid ridge integral with rigid body and extending outwardly from the leading and trailing edges. The ridge has a number of through extending holes formed in it outwardly of the rigid body element, and has an average thickness of about 16–25% (e.g. 18–22%) of the average thickness of the body element, preferably between about 0.1–0.14 cm (e.g. about 0.12 cm). The ridge is substantially completely covered by a flexible material soft enough to minimize injury to a person impacted by it, and flexible enough to be deflected during movement through the water to provide a rudder action. Preferably the flexible material extends along substantially the entire extent of the rigid body element, including the base of the body element, thereby enhancing the safety and rudder performance of the fin. The fin is connected to the bottom surface of a sport board, such as a surfboard, wake board, sail board, water ski, body board, etc. near the rear. The fin may be releasably attached to the board.

20 Claims, 6 Drawing Sheets

14
20
12
15
26
10

18
15
13
45
44
16
20
10
11
14
26
20
12

WATERSPORT BOARD FIN CONSTRUCTION

BACKGROUND AND SUMMARY OF THE INVENTION

A surfboard fin with flexible edges is disclosed in U.S. Pat. No. 5,273,472 (the disclosure of which is hereby incorporated by reference herein) has developed a reputation for being an outstanding product for enhancing safety and control of surfboards, and also has applicability to other watersport boards such as wake boards, windsurfing boards, body boards, water skis, and the like. However there have been some practical problems associated with the construction of the boards. In the practical implementation of the products, a thin ridge (on the order of about 500ths of a centimeter) has been provided extending outwardly from the leading and trailing edges, with rectangular shaped holes provided in the ridge so that the flexible material (typically urethane) extends through the openings during molding, and provides a conventional mechanical lock of the urethane to the rigid body element of the fin. However with this thin ridge construction, it has been difficult to mold the ridge effectively with the holes in it necessary for the mechanical lock, and it is difficult to mold the urethane along the sides of the ridge. Also, when the fins hit a hard object, such as during surfing, such as a reef or a rock, the thin ridge tends to shatter, causing the urethane to separate from the rest of the fin. However if the ridge is made too thick, then the urethane will not have sufficient thickness itself to effectively perform its safety and rudder functions, or a mechanical lock cannot effectively be provided.

According to the present invention a watersport fin is provided which has enhanced functionality both in use and in ease of construction compared to the heretofore commercial versions of the 5,273,472 patent. In the fin according to the present invention, the rigid ridge integral with the rigid body has an average thickness approximately 18–25% of the average thickness of the body element (compared with about 10% in the commercial art), which for most fins translates into an average thickness of about 0.08–0.13 centimeters (e.g. about 0.1 centimeter). According to the invention it is also desirable to have the ridge and the flexible material covering the ridge extend along substantially the entire extent of the rigid body element forming the fin, including the base, thereby enhancing the safety and rudder actions of the fin compared to if the flexible material did not extend along the base.

According to one aspect of the present invention a watersport board fin is provided comprising the following components: A rigid body element having a leading edge and a trailing edge, and an average thickness. A rigid ridge integral with the rigid body and extending outwardly from the leading and trailing edges, the ridge having an average thickness approximately 16–25% of the average thickness of the body element. A plurality of through-extending holes formed in the ridge outwardly of the rigid body element. And, a flexible material covering which substantially completely covers the ridge of the rigid body element along the leading and trailing edges, and extends through the holes formed in the ridge to mechanically lock the flexible material to the ridge, the flexible material being soft enough to minimize injury to a person impacted by a leading or trailing edge of the fin, and being flexible enough to be deflected during movement through water to provide a rudder, anti-cavitation, action.

The flexible material preferably extends outwardly from the trailing edge ridge an average distance greater than it extends outwardly from the leading edge ridge. The rigid body element comprises the base and a tip, the base having a length much greater than the tip (e.g. as is conventional per se a length of over 9 centimeters at the base compared a length near the tip of only about 5 centimeters), and preferably the ridge and the flexible material covering the ridge extend along substantially the entire extent of the rigid body element, including the base, thereby enhancing the rudder action of the fin compared to if the flexible material did not extend along the base. The rigid body element has side faces and the flexible material covers substantially only the ridge, not the side faces, in the preferred embodiment. Desirably the side faces have an uneven contour at the ridge so that the ridge extends outwardly from the rigid body element widely varying distances along the extent thereof which provides more secure attachment of the flexible material to the ridge. The ridge extends outwardly from the rigid body element along the trailing edge an average distance greater than (e.g. at least 10% greater than) it extends outwardly from the leading edge.

In the preferred embodiment the ridge has an average thickness of between about 0.1–0.14 centimeters, e.g. about 0.12 centimeter. While the base of the rigid body element has a width much greater than that of the tip (e.g. about 1.0 cm, tapering gradually to a thickness at the tip of about 0.5 centimeters), the ridge preferably has substantially a constant thickness.

As disclosed in the 5,273,472 patent, the rigid body element may have a Shore D hardness of at least 60 (e.g. at least 78), and the flexible material comprises an elastomeric material with a Shore A hardness of about 40–100. The flexible material preferably is urethane. The flexible material extends outwardly from the rigid body element along the trailing edge an average distance of at least about 0.35 centimeters, which distance is greater than the distance it extends outwardly from the rigid body element along the leading edge.

The side faces of the rigid body element may have an uneven contour at the ridge so that the ridge extends outwardly from the rigid body element widely varying distances along the extent thereof. The average variation of these distances at the ridge extends outwardly from the rigid body element is greater along the trailing edge than the leading edge. As shown in the 5,273,472 patent, preferably the tip is rounded at an intersection between the leading and trailing edges, and both the leading and trailing edges are curved, the leading edge curved toward the trailing edge.

The fin is provided in combination with a watersport board having a top and bottom surface, a front and a rear, the fin mounted on the board bottom surface closer to the rear than the front. The average position of the fin leading edge is closer to the front than the average position of the fin trailing edge. The fin may be glassed onto the board directly in a new construction (such as for example seen in U.S. Pat. No. 5,306,188), or may be part of a removable system, having surface manifestations which allow readily removable mounting to the board.

According to another aspect of the present invention a watersport board fin is provided comprising the following components: A rigid body element having a leading edge and a trailing edge, and an average thickness, and a base and a tip, the base having a width much greater than the tip. A rigid ridge integral with the rigid body and extending outwardly from the leading and trailing edges. A plurality of through-extending holes formed in the ridge outwardly of the rigid body element. A flexible material covering which substantially completely covers the ridge of the rigid body element along the leading and trailing edges, and extends through the holes formed in the ridge to mechanically lock the flexible material to the ridge, the flexible material being soft enough to minimize injury to a person impacted by a leading or trailing edge of the fin, and being flexible enough to be deflected during movement through water to provide a rudder, anti-cavitation, action. And, wherein the ridge and the flexible material covering the ridge extends along substantially the entire extent of the rigid body element, including the base, thereby enhancing the safety and rudder performance of the fin compared to if the flexible material did not extend along the base. The details of the components are preferably as described in the preferred embodiments above.

It is the primary object of the present invention to provide a watersport board fin that is easier to mold—both the fin itself and the flexible material along the leading and trailing edges thereof—than conventional fins of similar design, while at the same time improving the safety and rudder performances of the fin, and providing a more durable arrangement for the flexible material (such as urethane), while at the same time enhancing the flexibility and softness of the urethane. This and other objects of the invention will become clear from an inspection of the detailed description of the invention and from the appended claims.

DETAILED DESCRIPTION OF THE DRAWINGS

Figure 1:
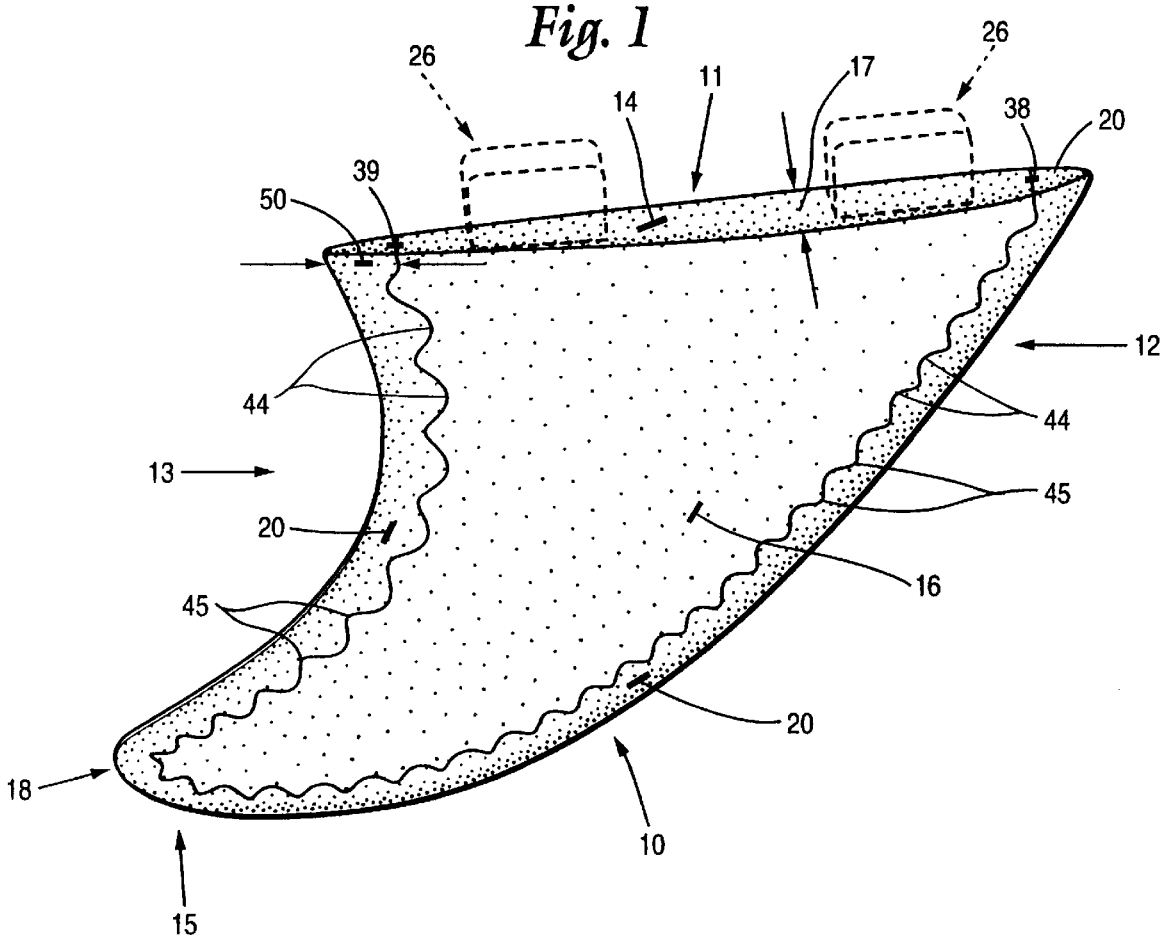
FIG. 1 is a top right perspective schematic view of an exemplary watersport board fin according to the present invention.
Figures 2, 3:
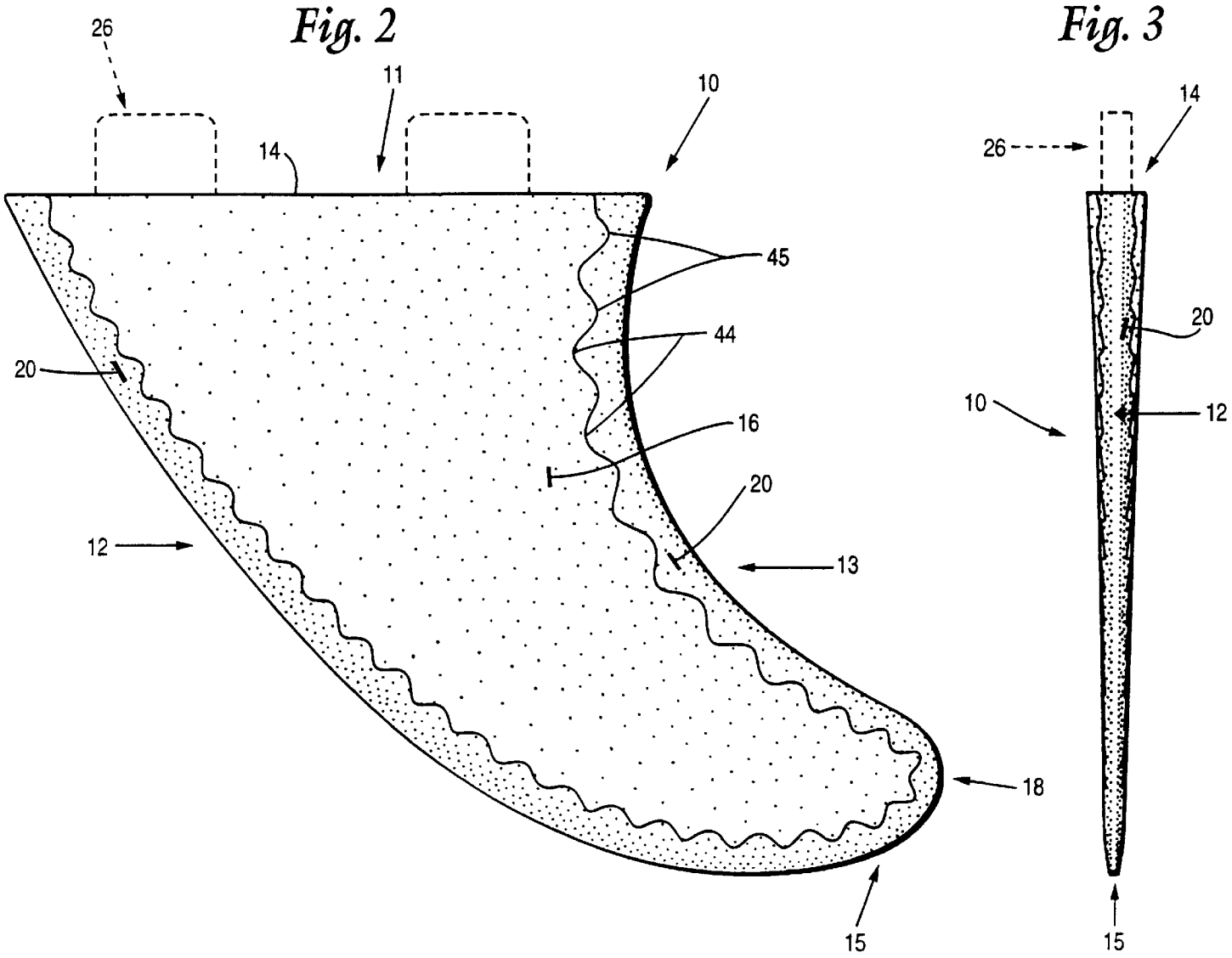
FIG. 2 is a left side view of the fin of FIG. 1.
FIG. 3 is a front end view the fin of FIG. 1.

An exemplary water sport board fin according to the present invention is shown generally by reference numeral 10 in FIGS. 1 through 3 and 5. The fin 10 includes a rigid body element 11 (e.g. of a materials and hardness as described in U.S. Pat. No. 5,273,472, the disclosure of which is incorporated by reference herein) having a leading edge 12 and a trailing edge 13, a base 14, a tip 15, side faces 16, and an average thickness, seen for the base 14 at reference numeral 17 in FIG. 1. In the preferred embodiment the average thickness gradually (although not necessarily uniformly, although preferably uniformly) decreases from the base 14 to the tip 15. For example in one embodiment where the fin 10 is used for a surfboard, the thickness 17 at the base 14 is between about 1.0 centimeters, while at the tip 15 it is about 0.5 centimeters. Although other configurations are suitable, especially for watersport boards of different types (e.g. wake boards as opposed to surfboards as opposed to body boards as opposed to water skis as opposed to windsurfing boards, etc.) preferably the tip 15 is rounded, as clearly seen in FIGS. 1 and 3, at an intersection, shown schematically at 18 in FIGS. 1 and 3, and both the leading 12 and trailing 13 edges are curved, the leading edge 12 curved toward the trailing edge 13, as also readily visible in both FIGS. 1 and 2.

The fin 10 according to the invention also includes a flexible material, such as an elastomer like urethane, rubber, silicone, etc., shown generally by reference numeral 20, disposed along the leading 12 and trailing 13 edges, but not significantly on the side faces 16. The fin 10 may be attached to the body surface 21 (see FIG. 6) of a watersport board 22 having a front 23 and a rear 24, as schematically illustrated in FIG. 6. The watersport board 22 may be a surfboard, windsurfing board, body board, wake board, water ski, or the like. The fin 10 is mounted closer to the rear 24 than the front 23, with the average position of the fin leading edge 12 closer to the front 23 (and thus being the leading edge) than the average position of the fin trailing edge 13. The fin 10 may be permanently attached to the bottom surface 21 of the board 22, such as by using fiberglass and/or adhesive, or the fin 10 may be attached using any of a wide variety of readily removable mounting systems. For example the fin 15 may have - - - as schematically illustrated in dotted line in FIGS. 1 through 3, and 5*a* - - - surface manifestation 26 which may be of any type, for cooperation with a receiving structure on the board 22 itself. Exemplary fin mounting systems that may be utilized are those such as shown in U.S. Pat. Nos. 3,516,099; 3,585,663, 4,493,665; 5,030,151; 5,176,096; and 5,328,397.

Figure 4A:
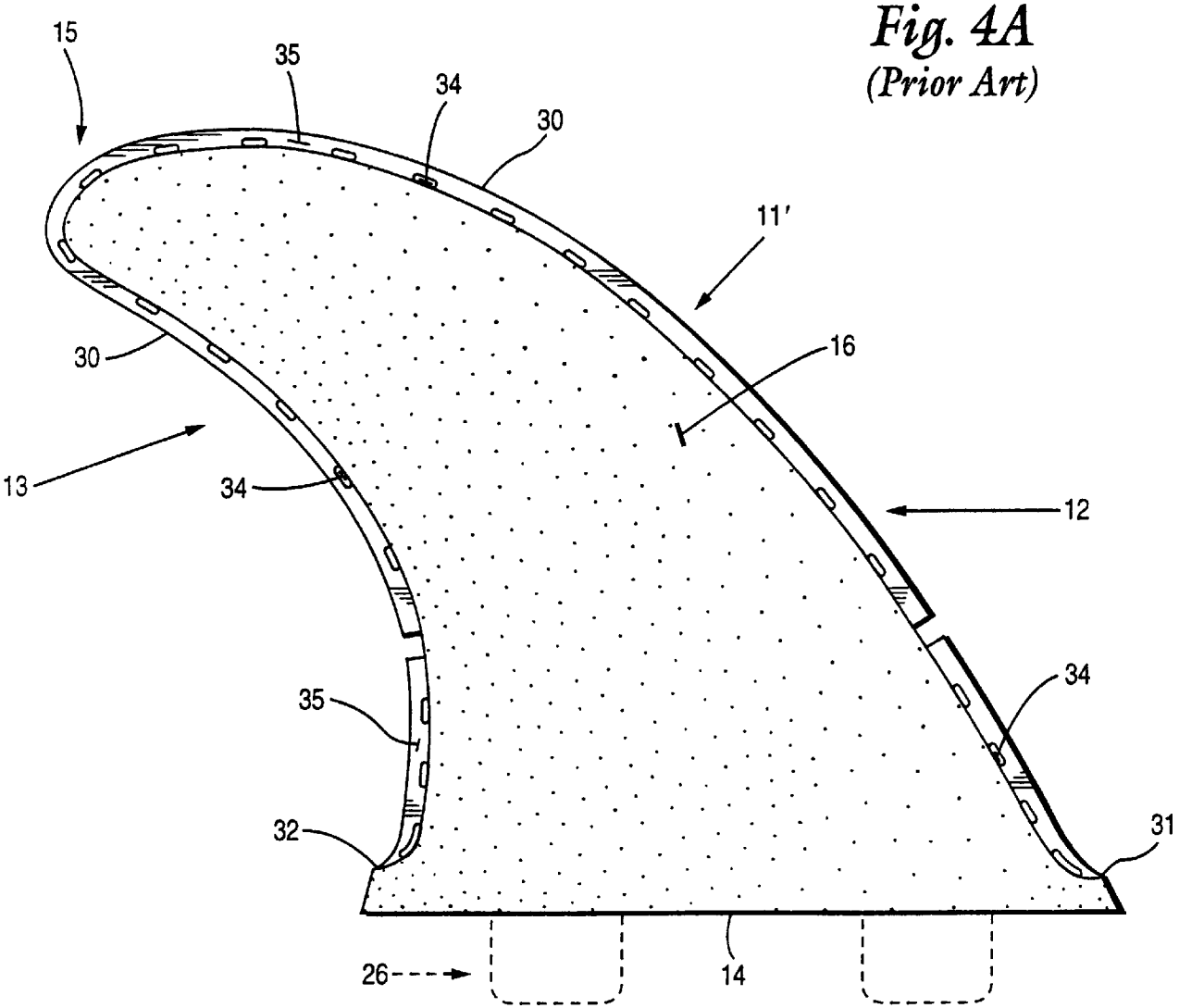
Fig. 4A (Prior Art)
FIGS. 4*a* and 4*b* are side and front views, respectively, of a conventional watersport board fin of the type shown in U.S. Pat. No. 5,273,472 before application of the flexible material thereto.
Figure 4B:
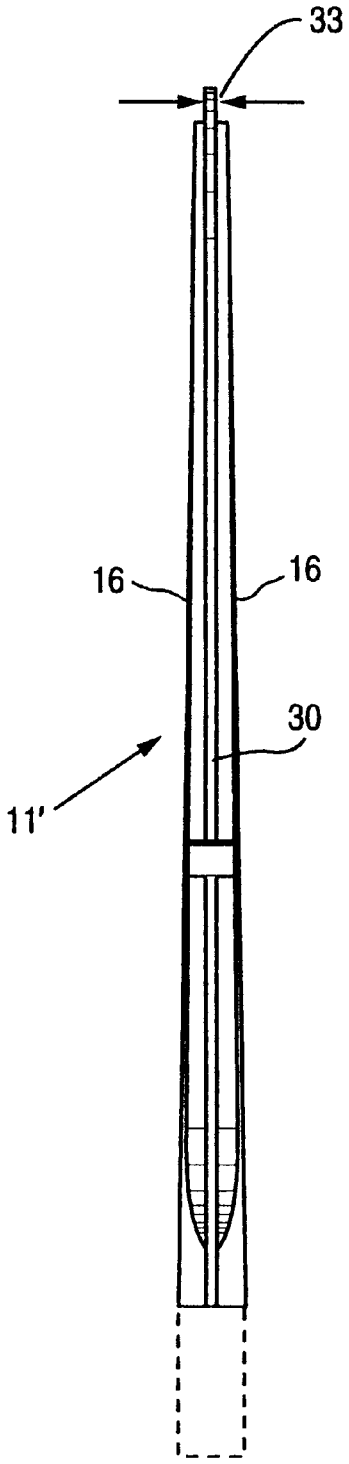
Fig. 4B (Prior Art)

FIGS. 4*a* and 4*b* show a conventional fin body 11' prior to molding of the flexible material (e.g. urethane) 20 thereon. In the prior art construction of FIGS. 4*a* and 4*b* components identical to those in the fin 10 according to the invention are shown by the same reference numeral.

In the prior art fin body 11', a thin rigid ridge is provided extending from a point 31 spaced from the base 14 along the entire leading edge, then back along the trailing edge 13 to another point 32 spaced from the base 14. The rigid ridge 30 is molded integrally with the rest of the body 11', and typically has a thickness of about 0.08 centimeters, about 12% of the average thickness of the body 11', this thickness being illustrated schematically at 33 in FIG. 4*b*. Also the ridge 30 has a plurality of through extending openings 34 therein, the openings this case being generally rectangular in shape and being disposed at the root of the ridge 30. The openings 34 are to allow the urethane or other flexible material to be mechanically locked to the ridge 30 by flowing through the openings 34 and forming a continuous piece of flexible material during the molding operation.

The fin rigid element 11' of the prior art of FIGS. 4*a* and 4*b* is difficult to mold, and it is difficult to mold the urethane along the sides 35 of the ridge 30. Also when the fin of which the element 11' is a part hits a hard object while surfing at the leading edge 12, or trailing edge 13, such is a reef or a rock, the thin ridge 30 has a tendency to shatter, causing the urethane to separate from the rigid element 11'. Also with the construction of FIGS. 4*a* and 4*b* it is difficult to make the urethane as wide as desired (which would enhance both the safety and rudder performance aspects of the fin). Also in the past it has been thought that the non-ridged area between the points 31, 32 and the base 14 were necessary for an effective construction, but it has been found according to the invention that that area is not always necessary, especially for removably mounted fins - - - and that it is advantageous for both the safety and rudder performance functions to have the ridge (and thus the urethane or other flexible material) extend substantially all the way from the leading edge of the base 14 to the trailing edge thereof.

Figure 5B:
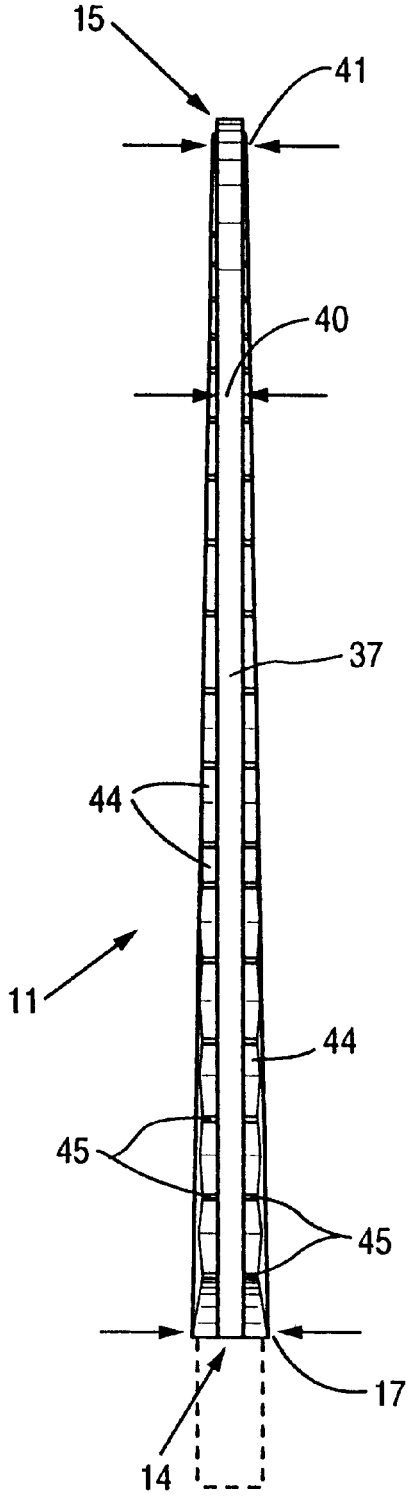
FIGS. 5*a* and 5*b* are views like those of FIGS. 4*a* and 4*b* only for a fin according to the invention.
Figure 5A:
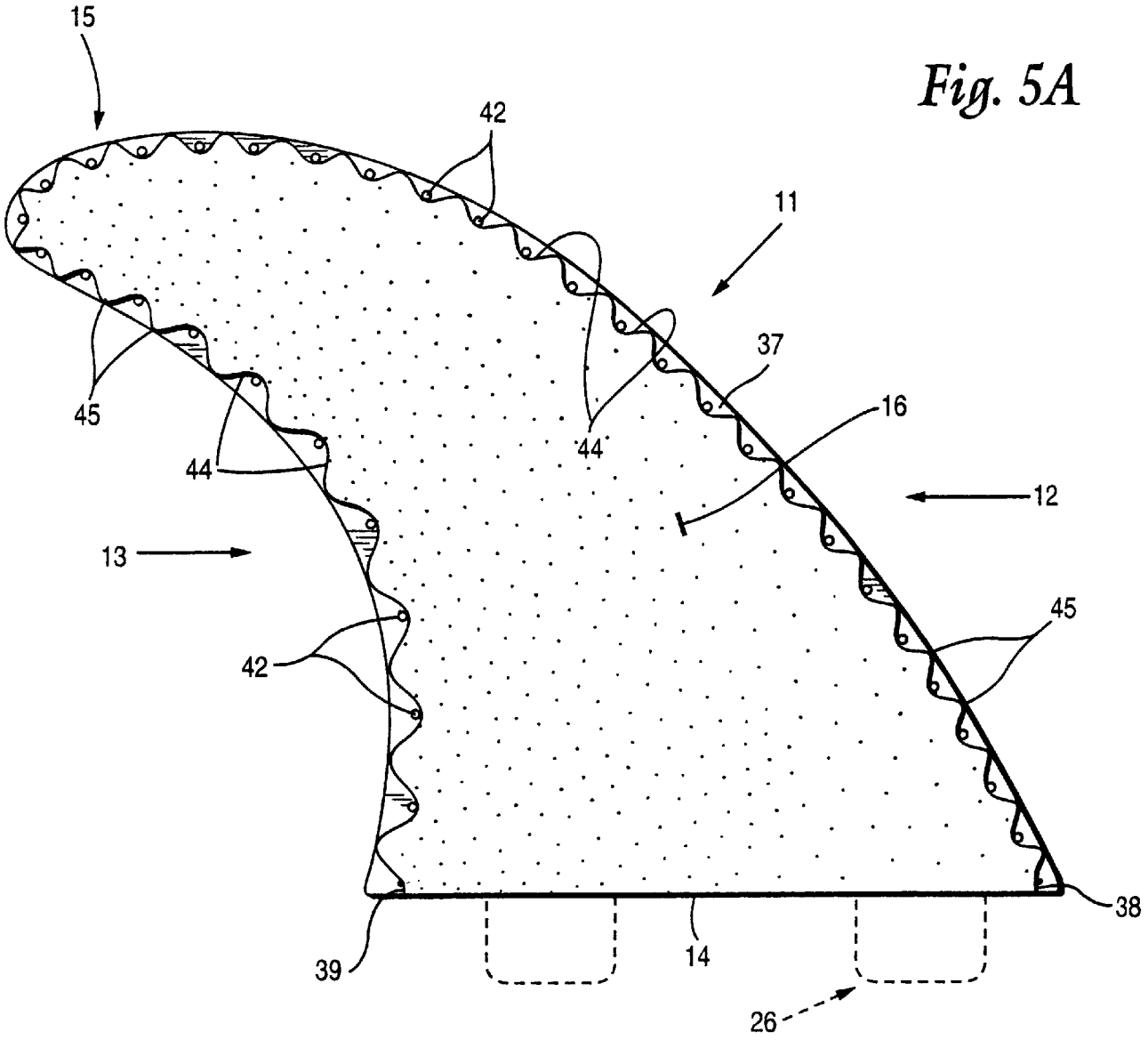
Figure 6:
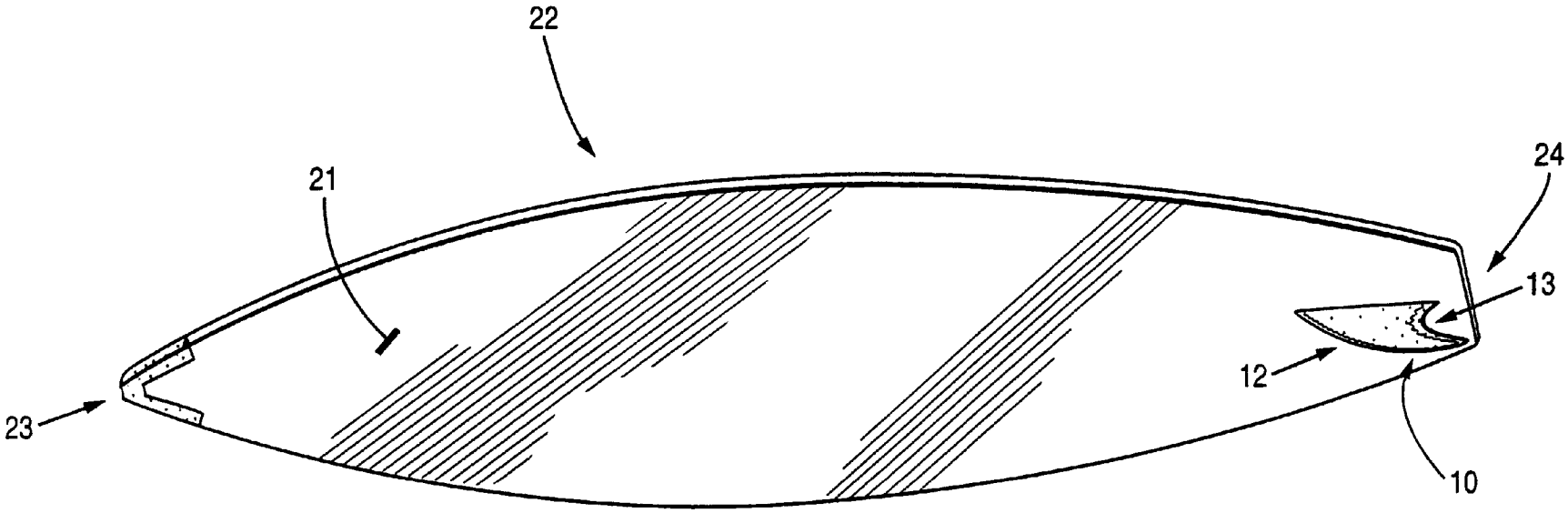
FIG. 6 is a bottom perspective schematic view of a fin according to the present invention mounted on the bottom of a watersport board.

The construction of the ridge of the rigid body element 11 according to the present invention - - - shown in FIGS. 5*a* and 5*b* before the application of the flexible material 20 thereto - - - is the primary distinction of the invention over the prior art (everything heretofore described being essentially conventional). According to the invention, the ridge 37 extends all the way from the leading edge of the base - - - at 38 in FIG. 5*a* - - - to the trailing edge of the base - - - at 39 in FIG. 5*a*. The thickness 40 of the ridge 37 is significantly greater than the thickness 33 of the prior art ridge 30. For example for the construction illustrated in the drawings, the thickness 40 is typically between about 0.1–0.14 centimeters, preferably between about 0.12–0.13 centimeters. For both this configuration, and others, the thickness 40 is preferably about 16–25% (e.g. about 18–22%) of the average thickness of the body 11; this average thickness at the base is shown at 17 in FIG. 5*b*, and adjacent the tip 15 is shown at 41 in FIG. 5*b*. Also while there may be variation in the thickness 40 of the ridge 37, in the preferred embodiment illustrated the thickness 40 remains substantially constant over the entire extent of the ridge 37 even though the thickness of the body 11 itself varies (e.g. from about 1.0 centimeters at 14 for the embodiment illustrated in the drawings, to about 0.5 centimeters for the thickness 41).

Also the rigid element 11 according to the invention has holes 42 which preferably are basically circular or oval in configuration, and most desirably near a portion of the ridge 37 closest to the body 11 itself, as seen in FIG. 5*a*. Also according to the invention, the side faces 16 have at the leading and trailing portions thereof, at the ridge 37, an uneven contour, as shown schematically by the valleys 44 and the peaks 45 in FIG. 5*a* and 5*b*, so that the ridge 37 extends outwardly from the rigid body element 11 widely varying distances along the extent thereof. The flexible material 20 thus also follows these contours, as readily seen in FIGS. 1 through 3. The provision of these contours - - - e.g. for example the distance that the ridge 37 extends from the main body element 11 - - - for the embodiment illustrated in the drawings - - - varying from about 0.5 centimeters at the deepest valley 44 to less than 0.1 centimeter, or even substantially zero, at the peaks 45 - - - facilitates secure attachment of the flexible material 20 to the body 11 and thereby slightly enhances the functionality of the fin 10. However it should be understood that the particular contour 44, 45 illustrated the drawings is aesthetic (ornamental), and the same function can be accomplished using a wide variety of other contours such as serrations, castellations, random peaks and valleys, etc.

As also readily seen in FIG. 5*a* the depth of the valleys 44 may vary, typically being larger along the trailing edge 13 than the leading edge 12, and during molding of the flexible material 20 onto the rigid element 11, the width of the flexible material 20 is greater along the trailing edge 13 than along the leading edge 12. As seen by a comparison of FIGS. 2 and 5*a*, the flexible material 20 preferably covers substantially only the ridge 37 (but substantially the entire ridge 37) but not the side faces 16. While the ridge 37 is preferably continuous as illustrated in FIGS. 5*a* and 5*b*, it may have gaps therein. Typically the flexible material 20 extends outwardly from the rigid body element 11 along the trailing edge 13 an average distance (for example see the distance 50 in FIG. 1) of at least about 0.35 centimeters, and greater than along the leading edge 12.

It will thus be seen that according to the present invention a watersport board fin is provided having a construction that makes both the rigid body element 11, and the flexible material (e.g. urethane) 20, easier to mold while still providing a solid mechanical lock, there is less tendency for the flexible material to separate from the rigid material of the fin 10, and both the safety and rudder action capabilities of the fin 10 are enhanced both by allowing the flexible material 20 to extend outwardly a greater distance from the body 11, and by providing it along substantially the entire leading and trailing edges 12, 13 (that is from the point 38 to the point 39 in FIGS. 5*a* and 1).

While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A watersport board fin comprising:

a rigid body element having a leading edge and a trailing edge, and an average thickness;

a rigid ridge integral with said rigid body and extending outwardly from said leading and trailing edges;

a plurality of through-extending holes formed in said ridge outwardly of said rigid body element;

a flexible material covering which substantially completely covers said ridge of said rigid body element along said leading and trailing edges, and extends through said holes formed in said ridge to mechanically lock said flexible material to said ridge, said flexible material being soft enough to minimize injury to a person impacted by a leading or trailing edge of said fin, and being flexible enough to be deflected during movement through water to provide a rudder, anti-cavitation, action; and wherein said rigid body element comprises a base, a tip, and side faces; and wherein said side faces have an uneven contour at said ridge so that said ridge extends outwardly from said rigid body element widely varying distances along the extent thereof.

2. A fin as recited in claim 1 wherein said flexible material extends outwardly from said trailing edge ridge an average distance greater than it extends outwardly from said leading edge ridge, and wherein said ridge has an average thickness of about 16–25% of said average thickness of said body element.

3. A fin as recited in claim 1 wherein said rigid body element comprises a base and a tip, said base having a width much greater than said tip; and wherein said ridge and said flexible material covering said ridge extend along substantially the entire extent of said rigid body element, including said base, thereby enhancing the safety and rudder performance of said fin compared to if said flexible material did not extend along said base.

4. A fin as recited in claim 3 wherein said rigid body element has side faces; and wherein said flexible material covers substantially only said ridge, and not said side faces.

5. A fin as recited in claim 4 wherein said side faces have an uneven contour at said ridge so that said ridge extends outwardly from said rigid body element widely varying distances along the extent thereof.

6. A fin as recited in claim 5 wherein said ridge extends outwardly from said rigid body element along said trailing edge an average distance greater than it extends outwardly from said leading edge.

7. A fin as recited in claim 1 wherein said ridge has an average thickness of between about 0.1–0.14 cm.

8. A fin as recited in claim 7 wherein said rigid body element comprises a base and a tip, said base having a width much greater than said tip, and said body element having a thickness at said base much greater than at said tip, but said ridge having a substantially constant thickness.

9. A fin as recited in claim 7 wherein said rigid body element has a thickness at said base of about 1.0 cm, tapering gradually to a thickness at said tip of about 0.5 cm, and wherein said ridge has a thickness of about 0.12 cm.

10. A fin as recited in claim 7 wherein said rigid body element has a Shore D hardness of at least 60, and said flexible material has a Shore A hardness of about 40–100; and wherein said flexible material extends outwardly from said rigid body element along said trailing edge an average distance of at least about 0.35 cm, and greater than along said leading edge.

11. A fin as recited in claim 1 wherein the average variation of the distances said ridge extends outwardly from said rigid body element is greater along said trailing edge than along said leading edge.

12. A fin as recited in claim 11 wherein said tip is rounded at an intersection between said leading and trailing edges, and wherein both said leading and trailing edges are curved, said leading edge curved toward said trailing edge.

13. A fin as recited in claim 1 in combination with a watersport board having a top and bottom surface, a front and a rear, said fin mounted on said board bottom surface closer to said rear than said front, with the average position of said fin leading edge closer to said front than the average position of said fin trailing edge.

14. A fin as recited in claim 13 wherein said fin has a base and a tip; and wherein said base has surface manifestations allowing readily removable mounting to said board; and wherein said fin is readily removably mounted to said board.

15. A fin as recited in claim 1 wherein said ridge has an average thickness approximately 18–22% of said average thickness of said body element.

16. A watersport board fin comprising:

a rigid body element having a leading edge and a trailing edge, and an average thickness;

a rigid ridge integral with said rigid body and extending outwardly from said leading and trailing edges, said ridge having an average thickness of between about 0.1–0.14 cm., and wherein said ridge has an average thickness approximately 18–22% of said average thickness of said body element;

a plurality of through-extending holes formed in said ridge outwardly of said rigid body element;

a flexible material covering which substantially completely covers said ridge of said rigid body element along said leading and trailing edges, and extends through said holes formed in said ridge to mechanically lock said flexible material to said ridge, said flexible material being soft enough to minimize injury to a person impacted by a leading or trailing edge of said fin, and being flexible enough to be deflected during movement through water to provide a rudder, anti-cavitation, action, and wherein said rigid body element comprises base and a tip, said base having a width much greater than said tip; and wherein said ridge and said flexible material covering said ridge extend along substantially the entire extent of said rigid body element, including said base, thereby enhancing the safety and rudder performance of said fin compared to if said flexible material did not extend along said base.

17. A fin as recited in claim 16 wherein said flexible material extends outwardly from said trailing edge ridge an average distance greater than it extends outwardly from said leading edge ridge; and in combination with a watersport board having a top and bottom surface, a front and a rear, said fin mounted on said board bottom surface closer to said rear than said front, with the average position of said fin leading edge closer to said front than the average position of said fin trailing edge; and wherein said fin has a base and a tip; and wherein said base has surface manifestations allowing readily removable mounting to said board; and wherein said fin is readily removably mounted to said board.

18. A watersport board fin comprising:

a rigid body element having a leading edge and a trailing edge, and an average thickness, and a base and a tip, said base having a width much greater than said tip;

a rigid ridge integral with said rigid body and extending outwardly from said leading and trailing edges;

a plurality of through-extending holes formed in said ridge outwardly of said rigid body element;

a flexible material covering which substantially completely covers said ridge of said rigid body element along said leading and trailing edges, and extends through said holes formed in said ridge to mechanically lock said flexible material to said ridge, said flexible material being soft enough to minimize injury to a person impacted by a leading or trailing edge of said fin, and being flexible enough to be deflected during movement through water to provide a rudder, anti-cavitation, action; and wherein said ridge and said flexible material covering said ridge extend along substantially the entire extent of said rigid body element, including said base, thereby enhancing the safety and rudder performance of said fin compared to if said flexible material did not extend along said base.

19. A fin as recited in claim 18 wherein said rigid body element comprises a base, a tip, and side faces; and wherein said side faces have an uneven contour at said ridge so that said ridge extends outwardly from said rigid body element widely varying distances along the extent thereof.

20. A fin as recited in claim 18 wherein said flexible material extends outwardly from said trailing edge ridge an average distance greater than it extends outwardly from said leading edge ridge; and in combination with a watersport board having a top and bottom surface, a front and a rear, said fin mounted on said board bottom surface closer to said rear than said front, with the average position of said fin leading edge closer to said front than the average position of said fin trailing edge; and wherein said base has surface manifestations allowing readily removable mounting to said board; and wherein said fin is readily removably mounted to said board.

* * * * *